US006149479A

United States Patent [19]

Redmon et al.

[11] Patent Number: 6,149,479

[45] Date of Patent: Nov. 21, 2000

[54] CANTED SIDE FIN WAKEBOARD

[75] Inventors: James Redmon, Carlsbad, Calif.; Charles Mehrmann, Bothell, Wash.

[73] Assignee: Earth & Ocean Sports, Inc., Hyannis, Mass.

[21] Appl. No.: 09/355,834

[22] PCT Filed: Jun. 18, 1999

[86] PCT No.: PCT/US99/13639

§ 371 Date: Aug. 3, 1999

§ 102(e) Date: Aug. 3, 1999

[87] PCT Pub. No.: WO99/65761

PCT Pub. Date: Dec. 23, 1999

Related U.S. Application Data

[60] Provisional application No. 60/089,731, Jun. 18, 1998.

[51] Int. Cl.[7] ..... B63B 1/00

[52] U.S. Cl. ..... 441/79; 441/74; 441/65

[58] Field of Search ..... 441/79, 74, 65; 114/140

[56] References Cited

U.S. PATENT DOCUMENTS

| | | | |
|---|---|---|---|
| 1,776,700 | 9/1930 | Pegna | 441/79 |
| 4,493,665 | 1/1985 | Liddle | 441/79 |
| 4,508,046 | 4/1985 | Coulter et al. | 114/39 |
| 4,720,280 | 1/1988 | Hufnagi et al. | 441/74 |
| 4,811,674 | 3/1989 | Stewart | 114/39.2 |
| 5,030,151 | 7/1991 | Beacham | 441/79 |
| 5,062,378 | 11/1991 | Bateman | 114/274 |
| 5,152,705 | 10/1992 | Rock | 441/74 |
| 5,306,188 | 4/1994 | Skedeleski et al. | 441/79 |
| 5,567,190 | 10/1996 | Oates | 441/79 |
| 6,059,621 | 5/2000 | Vogel | 441/74 |

FOREIGN PATENT DOCUMENTS

| | | | |
|---|---|---|---|
| 2516472 | 5/1983 | France | 441/79 |
| 2416158 | 6/1994 | France | 114/140 |
| 2751893 | 5/1979 | Germany | 441/74 |
| 4332216 | 6/1994 | Germany | 441/79 |
| 8001515 | 10/1981 | Netherlands | 441/79 |

*Primary Examiner*—S. Joseph Morano
*Assistant Examiner*—Ajay Vasudeva
*Attorney, Agent, or Firm*—Richard P. Crowley

[57] ABSTRACT

A wakeboard having rear and front center fins and a pair of spaced-apart, generally parallel, canted rear and front asymmetric side fins to provide enhanced rider control and performance of the wakeboard during maneuvers.

14 Claims, 4 Drawing Sheets

CANTED SIDE FIN WAKEBOARD

REFERENCE TO PRIOR APPLICATION

This application claims the benefit of the filing date of U.S. Provisional Patent Application Ser. No. 60/089,731, filed Jun. 18, 1998, and is hereby incorporated by reference.

BACKGROUND OF THE INVENTION

Wakeboards with or without (wakeskates) wake bindings are used behind watercraft, and typically and currently, have front and rear longitudinal center fins extending downwardly and generally perpendicularly, i.e., 90 degrees from the plane of the bottom wakeboard surface.

Wakeboards with such fins provide for control and hold by a rider in use. Thus, when a wakeboard lies flat in the water, the front, the rear, or both the front and rear fins protrude from the bottom of the wakeboard at about a right angle to the water surface.

It is desirable to provide for a new and improved wakeboard and method with increased rider hold and control and increased rider ability to change the wakeboard direction or orientation.

SUMMARY OF THE INVENTION

The invention relates to a wakeboard and method of use with canted or angled side fins to provide greater rider control, hold, and other advantages by a rider in use.

The wakeboard of the invention comprises a wakeboard or other type of water floatation board, particularly, but not solely, designed for use behind a watercraft, and which wakeboard has a generally planar bottom surface with at least one pair of canted side fins extending downwardly from the bottom surface, and each side fin having an interior side surface which is canted, i.e., extends outwardly or lies at an angle greater than 90 degrees from the perpendicular axis of the wakeboard.

The wakeboard of the invention can be used behind a watercraft and comprises a wakeboard having a longitudinal axis and perpendicular axis; a generally planar bottom surface; opposite, generally parallel side edges; a front end and a rear end; and at least one pair of side fins, each fin having an interior, generally planar side surface and an exterior, generally arcuate, convex side surface, and extending downwardly from the bottom surface and generally aligned with the longitudinal axis. The pair of side fins are at the front end, rear end, or both ends of the wakeboard and are spaced apart and positioned in a generally parallel relationship toward a front or a rear corner of the wakeboard, with the interior side surface of the side fins canted outwardly at an angle from the perpendicular axis of the wakeboard, toward the side edges sufficient to provide improved hold and control to a rider in use.

Generally, the side fins are the same or an asymmetric similar shape and are employed to the right and left of the longitudinal axis of the board and at the front, the rear, or both the front and rear board corners. Preferably, the canted side fins are employed in conjunction with the front, or the rear, or both the front and rear center fins which extend downwardly and generally perpendicularly from the bottom board surface. The center fins may be a selected shape and typically are symmetrical fins with two convex side surfaces and extend 90 degrees from the longitudinal axis. Generally, but not necessarily, the side fins are positioned parallel to the center fins and slightly forward or backward of the center fins; or where no center fins are used, the side fins are generally parallel and spaced apart on each side of the bottom surface of the wakeboard.

The canted side fins may vary in depth, width, and length; but usually are of the same size and shape (or smaller than the center fins) and often, but not necessarily, mimic the size of the center fins. The side fins may be integrally formed or removably secured to the bottom surface. The side fins used in a standard size wakeboard, e.g., from about 48 to 60 inches in length, range from about ½ to 4 inches in depth and about 2 to 12 inches in length. Optionally and preferably, the side fins are asymmetrically curved on the exterior surface and planar or flat on the interior surface, in a cross-sectional shape, with a trailing edge extending backward.

The degree of angular offset or cant of the side fins may vary from about 60 degrees, or more typically from 5 to 20 degrees from the perpendicular axis of the wakeboard but generally aligned with the longitudinal axis, such as an interior canted side surface of 100 to 105 degrees and an exterior canted side surface of 95 to 105 degrees.

It has been discovered that the canting of the side fins on a wakeboard enhances the rider's control and hold in a turn, while increasing the use area of the fin as the turn gets sharper. Further, it has been discovered that when a wakeboard is angled over on its edge in a turn, the angle of the fin relative to the water decreases from its maximum position of 90 degrees, to a lesser angle, relative to the amount of leaning over that a rider exerts during the turn. As the angle of the turn increases, the angle of the fin relative to the surface of the water decreases, thereby decreasing the depth of the fin in the water. As the force exerted in the turn continues, the effect of the fin in the water decreases, because the angle of the fin in the water decreases. Presently, the controlling force of a fin is increased by simply increasing the surface area of the fin, but at a point this increase in surface area becomes detrimental because the fin gets too big. At this point, the fins do not release, and hinder a rider's ability to perform tricks. Also, a large fin located on the center longitudinal axis at the end of the board makes it difficult to break free and slide the board sideways, or to change orientation (spin the board end for end).

The canted pair of side fins of the wakeboard of the invention solves the problem of increasing the hold and control in a turn, while increasing the rider's ability to change direction or board orientation.

The use of center fins at the front, the rear, and both the front and rear of the wakeboard is optional, but preferred, and permits the wakeboard to track in use; however, when a turn is made, particularly a sharp turn where the center fin raises out or substantially out of the water surface, the wakeboard loses its center fin tracking action. The wakeboard, with side fins on either side of the center fin, enhances rider control, performance, and tracking during wakeboard turns, reversals, and maneuvers.

The wakeboard includes a pair of side fins placed to the right and left of the longitudinal axis, with the side fins placed toward or on the corners of the board. The fins are attached to the base of the board at an outward angle of greater than 90 degrees to the surface of the board at the point of contact. By canting the fins out at an angle, turning and control of the board is enhanced, because fins are now placed deeper into the water as the turn is initiated and carried out. Additionally, as the angle of the turn is increased, the angle of the fin gets steeper, and the side fin in the water has increased effectiveness. As the turn decreases, the effect of the outside fins decreases, therefore giving the rider less fin as the need for the fin decreases.

Installing pairs of canted side fins at each corner of the board increases a rider's control and enables the use of smaller profile fins.

The invention shall be described for the purposes of illustration only in connection with certain embodiments; however, it is recognized that those persons skilled in the art may make various additions, improvements, modifications, and changes to the illustrated embodiments, without departing from the spirit and scope thereof.

DESCRIPTION OF THE EMBODIMENTS

Figure 1:
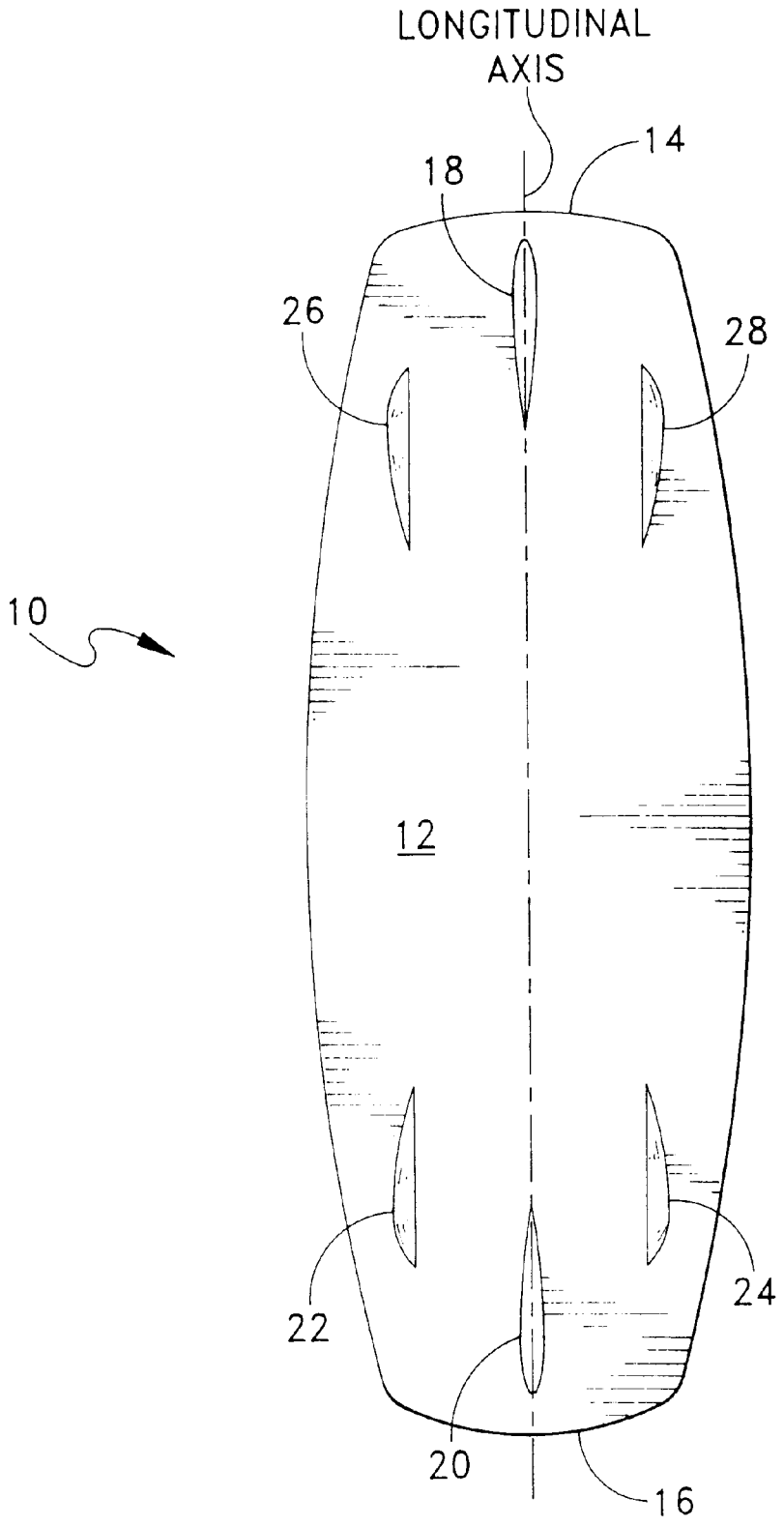
FIG. 1 is a bottom plan view of the wakeboard of the invention with canted side fins and central fins.
Figure 2:
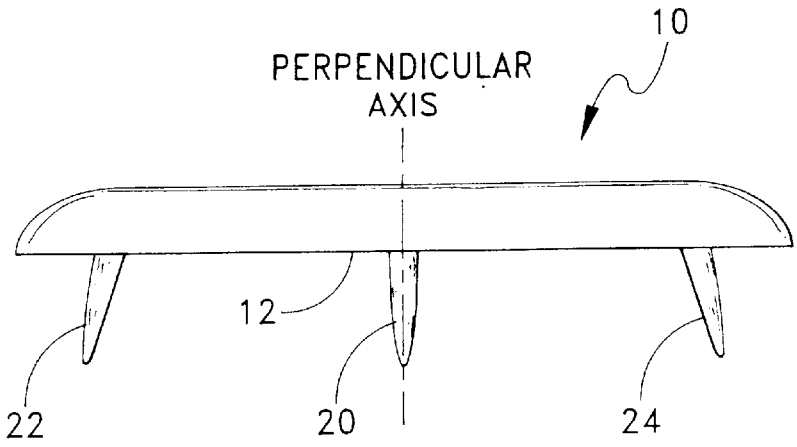
FIG. 2 is a plan, rear end view of the wakeboard of FIG. 1.

In the drawings, FIGS. 1 and 2 show a wakeboard 10 with a planar bottom surface 12 having front and rear centrally-aligned, longitudinal axis symmetrical fins 18 and 20, and with slightly outwardly canted, asymmetrical, front side fins 26 and 28, and rear side fins 22 and 24. All front and rear side fins have the same curved shape and extend respectively toward the front 14 and the rear 16 of the wakeboard 10 and toward the rear or back of the central fins 18 and 20, but with side surfaces which overlap the side surfaces of the central fins.

FIG. 2 is a plan, rear end view of the wakeboard of FIG. 1, which illustrates the perpendicular portion of the rear center fin 20 from the bottom surface 12 and the canted slightly outwardly, position and shape of the opposing rear side fins 22 and 24.

Figure 3:
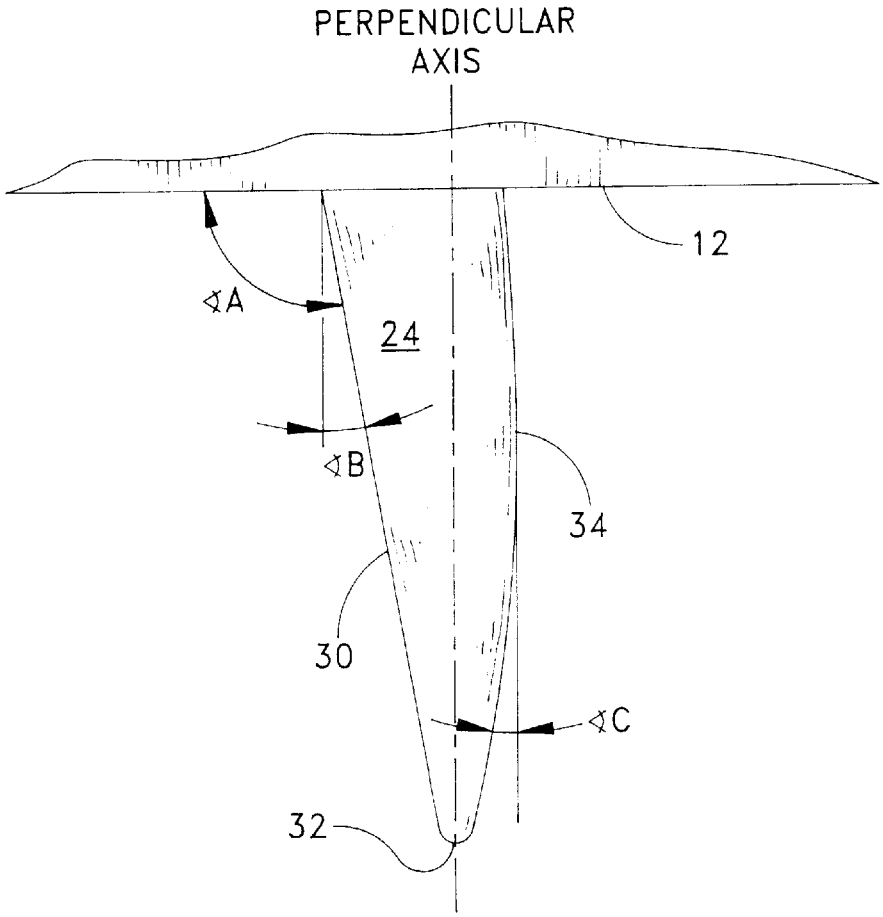
FIG. 3 is an enlarged schematic view of the right hand canted side fin of FIG. 2.

FIG. 3 shows a canted side fin 24 with an interior, generally straight side fin on a flat-planar surface 30, a slightly inward curved fin tip 32, and an exterior, arcuate, asymmetrical, convex side fin surface 34. In one embodiment, the rear side fin 24, like the rear side fin 22, has a base thickness of about 9/32" (e.g., about ¼ to ½"); a depth of about 1" (e.g., ¾ to 3"); a rounded tip thickness of about 1/16"; and a length of about 6" (e.g., 4 to 12"). Angle A is the outward canted angle between the plane or bottom surface 12 and the surface 30 of about 102 degrees, with Angle B representing a 12 degree (e.g., about 6 to 24 degrees) cant from the 90 degree line, while side surface 34 has an outward cant Angle C of about 85 to 88 degrees.

Figure 4:
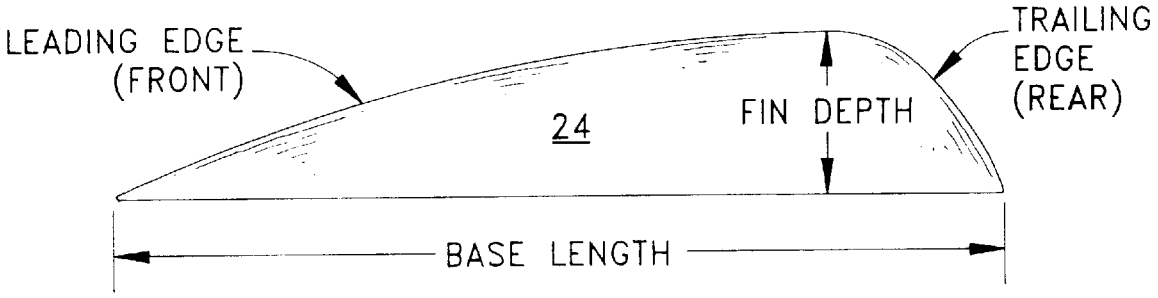
FIG. 4 is a an en enlarged side view of one side of the fin of FIG. 3.

FIG. 4 is a side plan view of rear side fin 24 illustrating the rear side fin dimensions and position, with the leading edge of the side fin 24 tapered to a rounded edge toward the front of the wakeboard in its forward movement, and a larger arcuate curve on the rear trailing edge. The side fin depth is at its greatest depth toward the last 15 to 25 percent of the fin length.

Figure 5A:
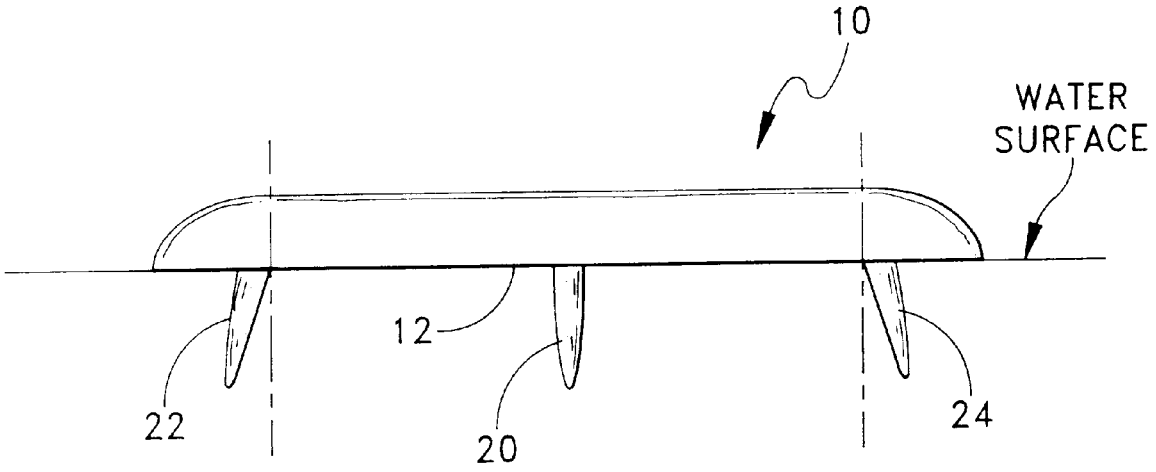
FIGS. 5A and 5B are schematic, plan rear end views of the wakeboard of FIG. 1 showing the water line to illustrate the effect of canted side fins at rest in FIG. 5A and in a turn in FIG. 5B.
Figure 5B:
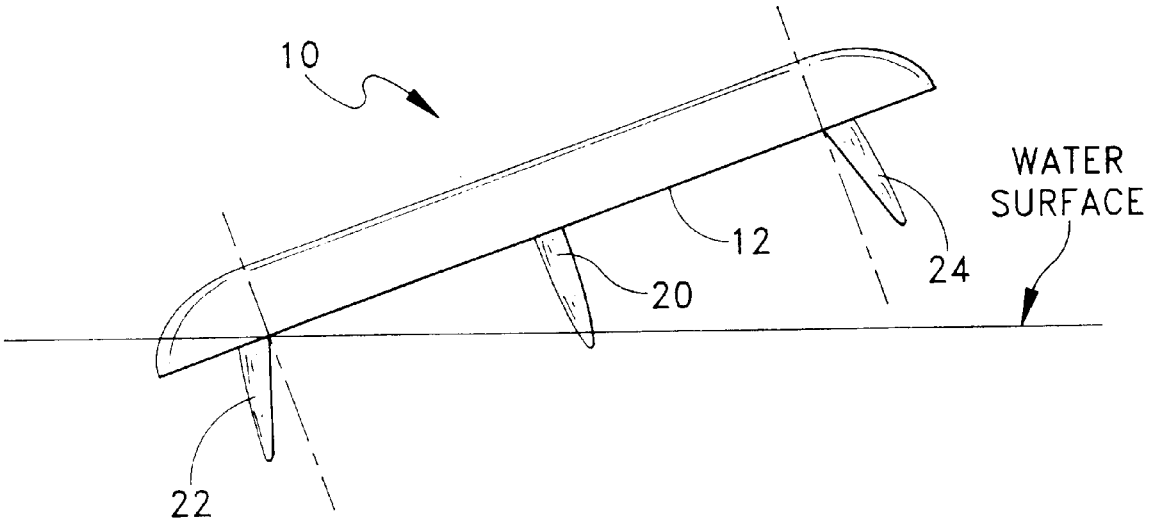

FIGS. 5A and 5B show the wakeboard and water line or water surface to illustrate the effect of canted side fins. Conventional wakeboards only use a center fin; and as the diagrams show, there is dramatic improvement in control if side fins are added. Also, when the board is in the flat position (FIG. 5A), the canting of the fin minimizes the effect, and upon turning to the left (FIG. 5B), the effect is increased, since the center fin is substantially out of the water, while the left rear turning fin 22 permits the rider to maintain tracking and control in the turn as the side fin 22 and the left edge of the wakeboard 10 are forced into the water. In the illustration, the right side fin 24 (FIG. 5B) is out of the water, and above the water line, and has no effect on the wakeboard performance.

What is claimed is:

1. A wakeboard for use behind a watercraft, which wakeboard comprises:

a) a longitudinal axis and perpendicular axis; a generally planar bottom surface; opposite side edges; and a front end and a rear end; and b) at least one pair of side fins, each having an interior, generally planar side surface and an exterior, generally arcuate, convex side surface, wherein the side fins are characterized by an inwardly turned tip, and extending downwardly from the bottom surface, and generally aligned with the longitudinal axis; the pair of side fins at the front end, rear end, or both ends of the wakeboard are spaced apart and positioned in a generally parallel relationship toward a front or a rear corner of the wakeboard, the interior side surface of the side fins canted outwardly at an angle from the perpendicular axis of the wakeboard, toward the side edges sufficient to provide improved hold and control to a rider in use.

2. The wakeboard of claim 1 which includes a front, a rear, or both front and rear center fins extending downward from the bottom surface.

3. The wakeboard of claim 2 wherein the side fins extend toward the rear of the front central fin or toward the front of the rear central fin, and have interior and exterior surfaces which transversely overlap the central fin or fins.

4. The wakeboard of claim 2 wherein the center fin has a symmetrical arcuate shape and extends downwardly and generally perpendicular to the bottom surface of the wakeboard.

5. The wakeboard of claim 1 wherein the side fins have a depth of about ½ to 4 inches and a length of about 2 to 12 inches.

6. The wakeboard of claim 1 wherein the side fins are canted at an angle of about 6 to 24 degrees.

7. The wakeboard of claim 1 wherein the rear side fins have an elongated, arcuate traverse profile with a narrow leading edge toward the front of the wakeboard.

8. The wakeboard of claim 1 wherein the side fins are of the same depth, or length, or both length and depth.

9. A wakebord for use behind a watercraft to provide improved rider hold and control during turns, which wakeboard comprises:

a) a longitudinal axis and a perpendicular axis; a generally planar bottom surface; opposite side edges; and a front end and a rear end;

b) a front central fin and a rear central fin, the central fins extending generally downwardly from the bottom surface and along the perpendicular axis; and c) two pairs of side fins, each side fin having an interior, flat side surface and an exterior, convex side surface and extending downwardly from the bottom surface; the side fins spaced apart and generally parallel to each other, and positioned on either side of the rear or front central fin, and extending slightly to the rear of the front or rear central fin, and with a profile that overlaps the rear or front central fin; the side fins canted slightly outwardly toward the side edges and from the perpendicular axis at an angle of about 6 to 24 degrees.

10. The wakeboard of claim 9 wherein the side fins have a length and depth, and the depth of the side fin is greatest toward the last 15 to 25 percent of the length.

11. The wakeboard of claim 9 wherein the convex side surface has an outward canted angle of about 85 to 88 degrees.

12. The wakeboard of claim 9 wherein the side fins are canted at an angle of about 6 to 24 degrees.

13. The wakeboard of claim 9 wherein the center fin has a symmetrical arcuate shape and extends downwardly and generally perpendicular to the bottom surface of the wakeboard.

14. The wakeboard of claim 9 wherein the side fins are characterized by an inwardly turned tip.

* * * * *